US009010138B2

(12) United States Patent
Yoshida et al.

(10) Patent No.: US 9,010,138 B2
(45) Date of Patent: Apr. 21, 2015

(54) VARIABLE DISPLACEMENT COMPRESSOR

(75) Inventors: Hiroyuki Yoshida, Kariya (JP); Osamu Hiramatsu, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 571 days.

(21) Appl. No.: 13/432,793

(22) Filed: Mar. 28, 2012

(65) Prior Publication Data

US 2012/0247140 A1 Oct. 4, 2012

(30) Foreign Application Priority Data

Mar. 31, 2011 (JP) ..... 2011-079836

(51) Int. Cl.
*F25B 1/00* (2006.01)
*F04B 27/18* (2006.01)
*F04B 11/00* (2006.01)

(52) U.S. Cl.
CPC ..... *F04B 27/1804* (2013.01); *F04B 11/0091* (2013.01); *F04B 2027/1813* (2013.01); *F04B 2027/1827* (2013.01); *F04B 2027/1831* (2013.01)

(58) Field of Classification Search
CPC ..... F25B 1/00; F25B 9/002; F25B 2600/02; F25B 2600/027; F25B 2600/0271; F25B 2600/0272; F25B 2700/19; F25B 2700/193; F25B 2700/1931; F25B 2700/1933; F25B 31/02; F25B 49/02; F25B 2400/07
USPC ..... 62/115, 228.1, 228.3, 498, 213, 222.2, 62/222.1, 269, 270
See application file for complete search history.

(56) References Cited

U.S. PATENT DOCUMENTS 5,785,502 A * 7/1998 Ota et al. ..... 417/222.2
2005/0008499 A1* 1/2005 Umemura et al. ..... 417/222.2
2005/0244279 A1 11/2005 Murakami et al.
2006/0165535 A1 7/2006 Ota et al.

(Continued)

FOREIGN PATENT DOCUMENTS

DE 602006000066 T2 5/2008
JP 2001-003861 A 1/2001

(Continued)

OTHER PUBLICATIONS

Communication dated Dec. 23, 2014 from the German Patent Office in counterpart application No. 10 2012 204 794.8.

*Primary Examiner* — Frantz Jules
*Assistant Examiner* — Azim Abdur Rahim
(74) *Attorney, Agent, or Firm* — Sughrue Mion, PLLC

(57) ABSTRACT

A variable displacement compressor adjusts the pressure in a control pressure chamber and controls the displacement in accordance with the adjusted pressure. Refrigerant is supplied via a supply passage, and released via a bleed passage. The compressor includes a first control valve for adjusting the cross-sectional area of the supply passage for refrigerant. The compressor further includes a second control valve that adjusts the cross-sectional area of the bleed passage in accordance with the opening/closing state of the first control valve. The second control valve adjusts the cross-sectional area of the bleed passage such that the cross-sectional area when the first control valve is in the closed state is larger than that when the first control valve is in the opened state. The back pressure chamber is located in a section of the bleed passage that is located between the second control valve and the control pressure chamber.

5 Claims, 3 Drawing Sheets

(56) References Cited

U.S. PATENT DOCUMENTS

| | | | | |
|---|---|---|---|---|
| 2008/0107544 | A1 | 5/2008 | Hibino et al. | |
| 2008/0199328 | A1 | 8/2008 | Hayashi et al. | |
| 2009/0269216 | A1* | 10/2009 | Ota et al. | 417/222.1 |
| 2010/0104454 | A1 | 4/2010 | Ota et al. | |

FOREIGN PATENT DOCUMENTS

| | | | |
|---|---|---|---|
| JP | 2005-337232 | A | 12/2005 |
| JP | 2008-115762 | A | 5/2008 |
| JP | 2009-264330 | A | 11/2009 |
| JP | 2010-106677 | A | 5/2010 |

* cited by examiner

VARIABLE DISPLACEMENT COMPRESSOR

BACKGROUND OF THE INVENTION

The present invention relates to a variable displacement compressor, which supplies refrigerant from a discharge pressure zone to a control pressure chamber and releases the refrigerant from the control pressure chamber to a suction pressure zone, thereby controlling the pressure in the control pressure chamber and controlling the displacement in accordance with the pressure in the control pressure chamber.

When the displacement of this type of variable displacement compressor is small, that is, when the flow rate of refrigerant is low, pulsation caused by self-excited vibration of reed valves reaches pipes outside the compressor, which generates unusual noise. Thus, the compressor disclosed in Japanese Laid-Open Patent Publication No. 2008-115762 has a first control valve in a suction passage that extends from a suction port for introducing refrigerant from the outside to the suction port in the compressor. The valve body of the first control valve is urged in a direction to close the suction passage, and the pressure in the valve chamber, which communicates with the crank chamber as a control pressure chamber and the suction pressure act against each other with the valve body in between. The first control valve adjusts the cross-sectional area of the suction passage in accordance with the pressure in the valve chamber.

When a compressor having such a first control valve is operating at a small displacement, the difference between the refrigerant pressure at the suction port and the refrigerant pressure in the suction chamber is reduced, so that the cross-sectional area of the suction passage is reduced, accordingly. This limits spread of pulsation caused by self-excited vibration of the reed valves to pipes outside the compressor.

However, when the first control valve, which controls the opening/closing state of the supply passage, is in an open state (an OFF state or a state for varying the displacement), the valve chamber and the suction chamber always communicate with each other. In this case, since the pressure in the valve chamber is relatively low, pulsation generated during the variable displacement operation may not be sufficiently limited.

SUMMARY OF THE INVENTION

Accordingly, it is an objective of the present invention to provide a variable displacement compressor that is capable of sufficiently limiting pulsation during the variable displacement operation.

To achieve the foregoing objective and in accordance with one aspect of the present invention, a variable displacement compressor, in which a suction pressure zone, a discharge pressure zone and a control pressure chamber are formed, is provided. The displacement of the variable displacement compressor varies in accordance with pressure in the control pressure chamber by supplying refrigerant in the discharge pressure zone to the control pressure chamber via a supply passage and releasing the refrigerant in the control pressure chamber to the suction pressure zone via a bleed passage. The variable displacement compressor includes a first control valve for adjusting the cross-sectional area of the supply passage, a suction restricting valve having a valve body and a back pressure chamber, and a second control valve. The valve body changes the cross-sectional area of a suction passage that extends from the external refrigerant circuit to the suction chamber, and the back pressure chamber is used for applying a back pressure to the valve body to act against the pressure in the suction passage. The second control valve adjusts the cross-sectional area of the bleed passage in accordance with the opening/closing state of the first control valve. The second control valve adjusts the cross-sectional area of the bleed passage such that the cross-sectional area of the bleed passage when the first control valve is in the closed state is larger than that when the first control valve is in the opened state. The back pressure chamber is located in a section of the bleed passage that is located between the second control valve and the control pressure chamber.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A clutchless type variable displacement compressor according to one embodiment of the present invention will now be described with reference to FIGS. 1 to 3.

Figure 1:
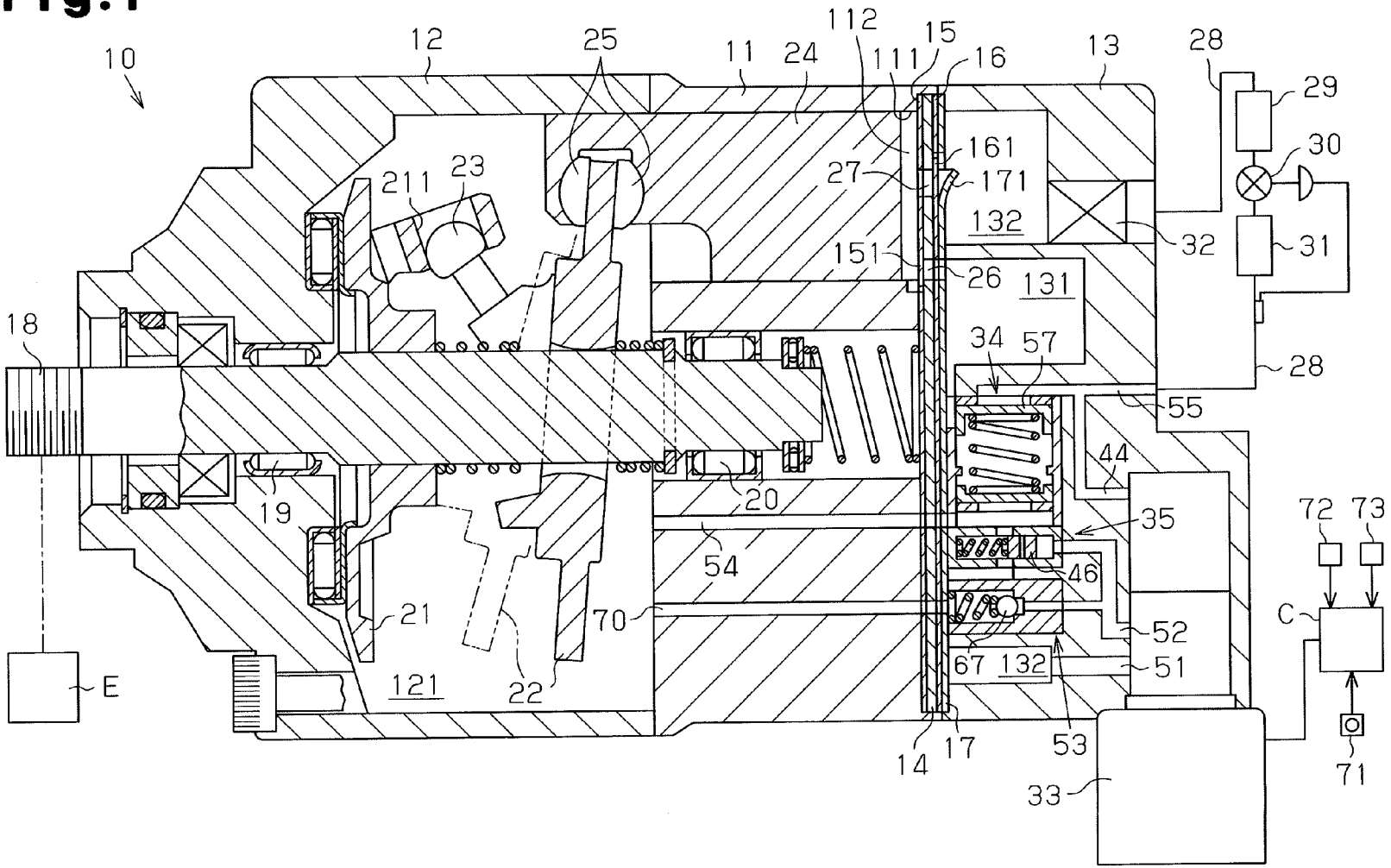
FIG. 1 is a cross-sectional side view showing a variable displacement compressor according to a first embodiment of the present invention.

As shown in FIG. 1, the housing of a variable displacement compressor 10 includes a cylinder block 11, a front housing member 12, and a rear housing member 13. The front end of the cylinder block 11 (the left end as viewed in FIG. 1) is coupled to the front housing member 12. The rear end of the cylinder block 11 (the right end as viewed in FIG. 1) is coupled to the rear housing member 13. A valve plate 14, valve flap plates 15, 16, and a retainer plate 17 are arranged between the cylinder block 11 and the rear housing member 13.

The front housing member 12 and the cylinder block 11 define a control pressure chamber 121. A rotary shaft 18 is rotationally supported by the front housing member 12 and the cylinder block 11 via radial bearings 19, 20. A first end of the rotary shaft 18 protrudes to the outside from the control pressure chamber 121. The rotary shaft 18 receives rotational drive force from an external power source E (not shown) such as a vehicle engine.

A rotary support 21 is fixed to the rotary shaft 18. A swash plate 22 is arranged to face the rotary support 21. The swash plate 22 is supported by the rotary shaft 18 to be permitted to incline with respect to and slide along the rotary shaft 18.

Guide holes 211 are formed in the rotary support 21. A pair of guide pins 23 is formed on the swash plate 22. The guide pins 23 are slidably fitted in the guide holes 211. The engagement of the guide holes 211 with the guide pins 23 allows the swash plate 22 to rotate integrally with the rotary shaft 18 and to move in the axial direction of the rotary shaft 18 while being inclined. The swash plate 22 is inclined by moving the swash plate 22 along the axis of the rotary shaft 18 with the guide pins 23 engaged with the guide holes 211.

When the center of the swash plate 22 moves toward the rotary support 21, the inclination angle of the swash plate 22 increases. The increase in the inclination angle of the swash plate 22 is limited by contact between the rotary support 21 and the swash plate 22. At this time, the inclination angle of the swash plate 22 is maximized (maximum inclination angle). When in a position indicated by solid lines in FIG. 1, the swash plate 22 is at the minimum inclination angle position. When in a position indicated by lines formed of a pair dashes alternating with a longer dash, the swash plate 22 is at the maximum inclination angle position. The minimum inclination angle of the swash plate 22 is set at a value slightly greater than zero degrees.

Cylinder bores 111 extend through the cylinder block 11. Each cylinder bore 111 accommodates a piston 24. The rotation of the swash plate 22 is converted to reciprocation of the pistons 24 by means of shoes 25. Thus, each piston 24 reciprocates in the corresponding cylinder bore 111.

A suction chamber 131 and a discharge chamber 132, which is a discharge pressure zone, are defined in the rear housing member 13. Suction ports 26 extend through the valve plate 14, the valve flap plate 16, and the retainer plate 17. Each suction port 26 corresponds to one of the cylinder bores 111. Discharge ports 27 extend through the valve plate 14 and the valve flap plate 15. Each discharge port 27 corresponds to one of the cylinder bores 111. Suction valve flaps 151 are formed on the valve flap plate 15. Each suction valve flap 151 corresponds to one of the suction ports 26. Discharge valve flaps 161 are formed on the valve flap plate 16. Each discharge valve flap 161 corresponds to one of the discharge ports 27. The valve flap plate 15 and each piston 24 define a compression chamber 112 in the corresponding cylinder bore 111.

As each piston 24 moves from the top dead center to the bottom dead center (from right to left as viewed in FIG. 1), refrigerant in the suction chamber 131 is drawn into the associated compression chamber 112 through the corresponding suction port 26 while flexing the suction valve flap 151. When each piston 24 moves from the bottom dead center to the top dead center (from left to right as viewed in FIG. 1), refrigerant in the corresponding compression chamber 112 is discharged to the discharge chamber 132 through the corresponding discharge port 27 while flexing the discharge valve flap 161. The retainer plate 17 includes retainers 171, which correspond to the discharge valve flaps 161. Each retainer 171 restricts the opening degree of the corresponding discharge valve flap 161.

When the pressure in the control pressure chamber 121 is lowered, the inclination angle of the swash plate 22 is increased. This lengthens the stroke of each piston 24 and the compressor displacement is increased, accordingly. When the pressure in the control pressure chamber 121 is raised, the inclination angle of the swash plate 22 is decreased. This shortens the stroke of each piston 24 and the compressor displacement is decreased, accordingly.

The suction chamber 131 is connected to the discharge chamber 132 by an external refrigerant circuit 28. A heat exchanger 29 for drawing heat from the refrigerant, an expansion valve 30, and a heat exchanger 31 for transferring the ambient heat to the refrigerant are located on the external refrigerant circuit 28. The expansion valve 30 is an automatic thermal expansion valve that controls the flow rate of refrigerant in accordance with fluctuations of the temperature of gaseous refrigerant at the outlet of the heat exchanger 31. A circulation stopper 32 is located in a passage from the discharge chamber 132 to the external refrigerant circuit 28. When the circulation stopper 32 is open, refrigerant in the discharge chamber 132 flows to the external refrigerant circuit 28.

Figure 2:
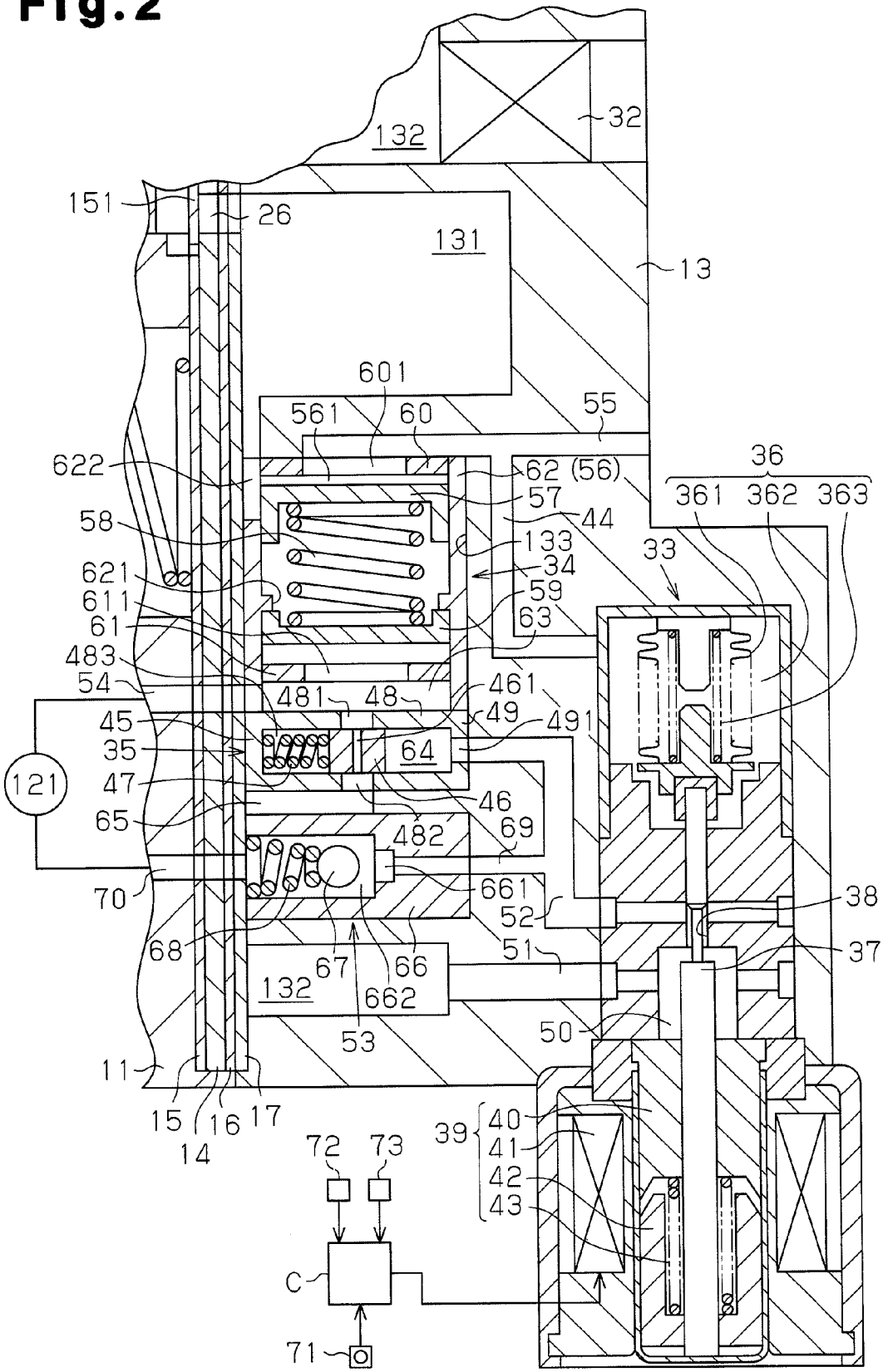
FIG. 2 is an enlarged partial cross-sectional side view of FIG. 1.

As shown in FIG. 2, an electromagnetic first control valve 33, a suction restricting valve 34, a second control valve 35, and a check valve 53 are installed in the rear housing member 13.

The first control valve 33 includes a solenoid 39. A fixed iron core 40 of the solenoid 39 attracts a movable iron core 42 based on excitation by current supplied to a coil 41. A valve body 37 is fixed to the movable iron core 42. The valve body 37 is urged toward a position for closing a valve hole 38 by electromagnetic force of the solenoid 39 against elastic force (spring force) of an urging spring 43. The solenoid 39 is subjected to current supply control (duty cycle control in this embodiment) executed by a control computer C.

The first control valve 33 has a bellows 361. The bellows 361 is exposed to the pressure of the external refrigerant circuit 28, which is downstream of the heat exchanger 31 (FIG. 1), via an introduction passage 55, a passage 44, and a pressure sensing chamber 362. The valve body 37 is connected to the bellows 361 and is urged from a position for closing the valve hole 38 to a position for opening the valve hole 38 by the pressure in the bellows 361 and the elastic force of a pressure sensing spring 363. The bellows 361 and the pressure sensing spring 363 form a pressure sensing portion 36. A valve accommodating chamber 50, which is continuous with the valve hole 38, communicates with the discharge chamber 132 via a passage 51.

The suction restricting valve 34 includes a valve housing 56 accommodated in an accommodating chamber 133, a valve body 57 accommodated in a valve chamber 561 in the valve housing 56, a urging spring 58, and a movable spring seat 59. The valve housing 56 includes a cylindrical portion 62 and a pair of end walls 60, 61 coupled to both ends of the cylindrical portion 62. The urging spring 58 urges the valve body 57 toward the end wall 60 and urges the movable spring seat 59 toward the end wall 61.

A flange 621 is formed on the inner circumference surface of the cylindrical portion 62. The valve body 57 is movable between a closing position, at which the valve body 57 contacts the end wall 60, and an opening position, at which the valve body 57 contacts the flange 621. The movable spring seat 59 is movable between a position at which the movable spring seat 59 contacts the flange 621 and a position at which the movable spring seat 59 contacts the end wall 61. A first valve hole 601, which communicates with the valve chamber 561, is formed in the end wall 60. A second valve hole 622, which connects the suction chamber 131 and the valve chamber 561 to each other, is formed in the cylindrical portion 62.

The end wall 61 defines a first back pressure chamber 63 in the cylindrical portion 62. A back pressure port 611, which communicates with the first back pressure chamber 63, is formed in the end wall 61. The first back pressure chamber 63 communicates with the control pressure chamber 121 via a passage 54.

As shown in FIG. 2, the second control valve 35 includes a valve housing 45 accommodated in the accommodating chamber 133, a valve body 46 as a second valve body accommodated in the valve housing 45, and a valve opening spring 47. The valve housing 45 has a cylindrical portion 48 and an end wall 49, and the valve opening spring 47 urges the valve body 46 toward the end wall 49. The valve body 46 defines a second back pressure chamber 64 in the valve housing 45. A back pressure port 491, which communicates with the second back pressure chamber 64, is formed in the end wall 49. The second back pressure chamber 64 communicates with the valve hole 38 of the first control valve 33 via a passage 52.

A third valve hole 481 and a fourth valve hole 482 are formed in the cylindrical portion 48. The third valve hole 481 communicates with the first back pressure chamber 63, and the fourth valve hole 482 communicates with the suction chamber 131 via a passage 65.

A restriction passage 461 extends through the valve body 46. When the valve body 46 is at the closing position, that is, when the valve body 46 covers the third valve hole 481 and the fourth valve hole 482, the third valve hole 481 and the fourth valve hole 482 communicate with each other via the restriction passage 461. When the valve body 46 is at the opening position, at which it opens the third valve hole 481 and the fourth valve hole 482, the third valve hole 481 and the fourth valve hole 482 communicate with each other via a spring accommodating chamber 483.

As shown in FIG. 2, the check valve 53 includes a valve housing 66, a valve body 67 accommodated in the valve housing 66, and a closing spring 68. The closing spring 68 urges the valve body 67 toward a position for closing a valve hole 661. The valve hole 661 communicates with the passage 52 via a passage 69. A valve accommodating chamber 662 communicates with the control pressure chamber 121 via a passage 70 that is formed to extend through the valve plate 14, the valve flap plates 15, 16, the retainer plate 17, and the cylinder block 11.

The passages 51, 52, 69, 70 form a part of supply passage for supplying refrigerant from the discharge chamber 132 to the control pressure chamber 121.

The control computer C, which executes the current supply control such as duty cycle control for the solenoid 39 of the first control valve 33, supplies current to the solenoid 39 when an air-conditioner switch 71 is turned ON, and stops supplying the current when the air-conditioner switch 71 is turned OFF. The control computer C is connected to a compartment temperature setting device 72 and a compartment temperature detector 73. When the air-conditioner switch 71 is ON, the control computer C controls current supplied to the solenoid 39 based on the difference between a target compartment temperature set by the compartment temperature setting device 72 and the temperature detected by the compartment temperature detector 73.

The opening state of the valve hole 38 of the first control valve 33, that is, the opening degree of the first control valve 33 as a valve opening degree is determined by the equilibrium of the electromagnetic force generated in the solenoid 39, the elastic force of the urging spring 43, and the urging force of the pressure sensing portion 36. The first control valve 33 is capable of continuously adjusting the opening degree of the first control valve 33 by changing the electromagnetic force generated in the solenoid 39. When the electromagnetic force is increased, a force that urges the valve body 37 toward a position for closing the valve hole 38 is increased, so that the opening degree of the first control valve 33 is reduced. Further, when the suction pressure in the introduction passage 55 is increased, the opening degree of the first control valve 33 is reduced. When the suction pressure in the introduction passage 55 is reduced, the opening degree of the first control valve 33 is increased. The first control valve 33 controls the suction pressure in the introduction passage to a target pressure, which corresponds to the electromagnetic force generated in the solenoid 39.

FIG. 2 illustrates a state in which the air-conditioner switch 71 is OFF, so that current supply to the solenoid 39 of the first control valve 33 is stopped (a state in which the duty cycle is zero). In this state, the opening degree of the first control valve 33 is maximized. Since the minimum inclination angle of the swash plate 22 (FIG. 1) is set at a value slightly greater than zero degrees, refrigerant is discharged to the discharge chamber 132 from the cylinder bores 111 even if the inclination angle of the swash plate 22 is minimum. In this state, the circulation stopper 32 is closed to stop circulation of refrigerant in the external refrigerant circuit 28. Refrigerant that has been discharged to the discharge chamber 132 from the cylinder bores 111 reaches the valve hole 38 of the first control valve 33 and the passage 52. The pressure of refrigerant in the passage 52 acts on the second back pressure chamber 64 of the second control valve 35, and the valve body 46 of the second control valve 35 is moved to the closing position shown in FIG. 2 by the pressure in the second back pressure chamber 64.

Refrigerant in the passage 52 flows into the valve accommodating chamber 662 via the passage 69 and the valve hole 661 of the check valve 53, while pushing the valve body 67 toward an open position. The refrigerant that has flowed into the valve accommodating chamber 662 flows into the control pressure chamber 121 via the passage 70. The refrigerant in the control pressure chamber 121 flows to the suction chamber 131 via a bleed passage, which is formed by the passage 54, the first back pressure chamber 63, the third valve hole 481, the restriction passage 461, the fourth valve hole 482, and the passage 65. The refrigerant in the suction chamber 131 is drawn into the cylinder bores 111 and then returns to the discharge chamber 132.

In the state shown in FIG. 2, the inclination angle of the swash plate 22 is minimum, and the variable displacement compressor 10 performs an OFF operation (minimum displacement operation), in which the refrigerant displacement from the compression chambers 112 to the discharge chamber 132 is minimized. At this time, since the circulation stopper 32 is closed, refrigerant does not circulate through the external refrigerant circuit 28.

Figure 3:
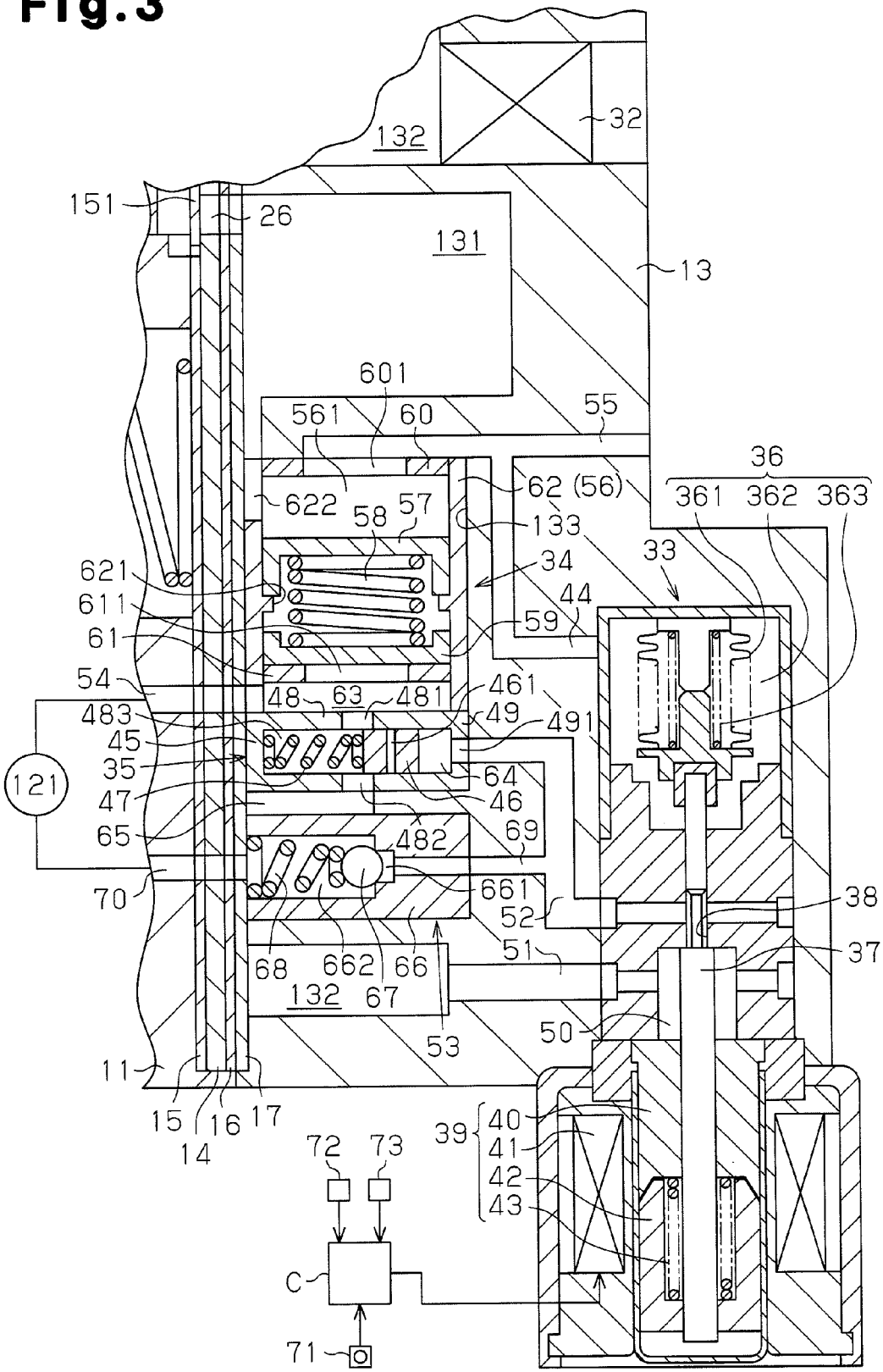
FIG. 3 is an enlarged partial cross-sectional side view of FIG. 1.

FIG. 3 illustrates a state in which the air-conditioner switch 71 is ON, so that current supply to the solenoid 39 of the first control valve 33 is maximized (a state in which the duty cycle is 1). The opening degree of the first control valve 33 is zero. When the variable displacement compressor 10 is operating at a non-minimized displacement (that is, when the inclination angle of the swash plate 22 is not minimized), the circulation stopper 32 is open, so that refrigerant in the discharge chamber 132 flows to the external refrigerant circuit 28. The refrigerant that has flowed out to the external refrigerant circuit 28 flows into the suction chamber 131 via a suction passage, which is formed by the introduction passage 55, the first valve hole 601, the valve chamber 561, and the second valve hole 622.

When the opening degree of the first control valve 33 is zero, that is, when the valve hole 38 is closed, the pressure of refrigerant in the discharge chamber 132 does not act on the second back pressure chamber 64 of the second control valve 35 via the supply passage. Therefore, the valve body 46 of the second control valve 35 is moved by the elastic force of the valve opening spring 47 to a position for maximally opening the third valve hole 481 and the fourth valve hole 482. The valve body 67 of the check valve 53 is moved to a position for closing the valve hole 661 by the elastic force of the closing spring 68.

That is, in the state shown in FIG. 3, since the supply passage is closed, the refrigerant in the discharge chamber 132 is not delivered to the control pressure chamber 121 via the supply passage. The refrigerant in the control pressure chamber 121 flows to the suction chamber 131 via a bleed passage, which is formed by the passage 54, the first back pressure chamber 63, the third valve hole 481, the spring accommodating chamber 483, the fourth valve hole 482, and the passage 65. In this state, the inclination angle of the swash plate 22 is maximized, and the variable displacement compressor 10 performs a maximum displacement operation, in which the displacement is maximized.

In a state in which the air-conditioner switch 71 is ON, the current supply to the solenoid 39 of the first control valve 33 is not zero or maximized (0<duty cycle<1), the pressure of refrigerant in the discharge chamber 132 acts on the second back pressure chamber 64 of the second control valve 35. The refrigerant that has been delivered from the discharge chamber 132 to the passage 52 passes through the check valve 53 and flows into the control pressure chamber 121. In this state, the inclination angle of the swash plate 22 is greater than the minimum inclination angle so that the suction pressure is adjusted to a target pressure corresponding to the duty cycle, and the variable displacement compressor 10 performs an intermediate displacement operation.

FIG. 1 shows the variable displacement compressor 10 when it is not activated. The second control valve 35 adjusts the cross-sectional area of the discharge passage such that the cross-sectional area of the bleed passage is maximized, that is, such that the valve holes 481, 482 are maximally opened. During the maximum displacement operation illustrated in FIG. 3, also, the second control valve 35 adjusts the cross-sectional area of the discharge passage such that the cross-sectional area of the bleed passage is maximized, that is, such that the valve holes 481, 482 are maximally opened. That is, the second control valve 35 adjusts the cross-sectional area of the bleed passage such that the cross-sectional area of the bleed passage when the first control valve 33 is closed is larger than that when the first control valve 33 is open.

Thus, liquid refrigerant in the control pressure chamber 121 is readily released to the suction chamber 131 via the bleed passage, which is formed by the passage 54, the first back pressure chamber 63, the third valve hole 481, the spring accommodating chamber 483, the fourth valve hole 482, and the passage 65. This promotes a quick increase in the displacement of the variable displacement compressor 10 immediately after it is activated.

The cross-sectional area of the bleed passage in the variable displacement operation is smaller than that in the maximum displacement operation. This improves the operational efficiency of the variable displacement compressor 10 during the variable displacement operation.

Operation of the present embodiment will now be described.

In the maximum displacement operation, which the valve holes 481, 482 are maximally opened, the passage 54, the first back pressure chamber 63, the third valve hole 481, the spring accommodating chamber 483, the fourth valve hole 482, and the passage 65 form the bleed passage. Accordingly, the cross-sectional area of the bleed passage is large, and the pressure in the first back pressure chamber 63 is low. Therefore, the valve body 57 of the suction restricting valve 34, which changes the cross-sectional area of the suction passage, is moved to a position for maximally opening the valve holes 601, 622 by the refrigerant pressure in the valve chamber 561, and the movable spring seat 59 is moved to a position for contacting the end wall 61.

During the minimum displacement operation (the OFF state) or during the variable displacement operation, the passage 54, the first back pressure chamber 63, the third valve hole 481, the fourth valve hole 482, and the passage 65 form the bleed passage. Accordingly, the cross-sectional area of the bleed passage, which reaches the suction chamber 131, is smaller than that in the maximum displacement operation, and the pressure in the first back pressure chamber 63 is high. Therefore, the movable spring seat 59 is moved to a position for contacting the flange 621, and the valve body 57 of the suction restricting valve 34 is moved, against the refrigerant pressure in the first valve hole 601, to a position close to the closing position for closing the valve holes 601, 622. That is, the suction restricting valve 34 reduces the cross-sectional area of the suction passage, so that pulsation during the variable displacement operation is prevented from spreading.

The first embodiment has the following advantages.

(1) The second control valve 35 contributes to a quick increase in the displacement of the variable displacement compressor 10 immediately after activation and to improvement of the operational efficiency of the variable displacement compressor 10. The second control valve 35, which achieves those advantages, reduces the cross-sectional area of the bleed passage in the variable displacement operation. Therefore, the pressure in the first back pressure chamber 63 in the variable displacement operation is high. As a result, compared to a case in which the second control valve 35 is not provided, the suction restricting valve 34 further reduces the cross-sectional area of the suction passage, thereby sufficiently suppressing pulsation during the variable displacement operation.

(2) The suction restricting valve 34 and the second control valve 35 are accommodated in the common accommodating chamber 133 formed in the rear housing member 13. Therefore, compared to a case in which the suction restricting valve 34 and the second control valve 35 are separately accommodated in different accommodating chambers, the space required for accommodating the suction restricting valve 34 and the second control valve 35 is compact.

(3) When the intermediate displacement operation is being performed at a high discharge pressure, the control pressure in the control pressure chamber 121 cannot be lowered in some cases even if the first control valve 33 is shifted from the opened state to the closed state, due to leakage of refrigerant from the cylinder bores 111 to the control pressure chamber 121. If the control pressure, which cannot be lowered, acts on the second back pressure chamber 64 via the supply passage, only the elastic force of the valve opening spring 47 may be insufficient for overcoming the pressure in the second back pressure chamber 64. If the elastic force of the valve opening spring 47 cannot overcome the pressure in the second back pressure chamber 64, the valve body 46 of the second control valve 35 cannot be moved from the closing position to the opening position.

The check valve 53 prevents the control pressure that cannot be lowered from acting on the second back pressure chamber 64. Therefore, when the first control valve 33 is moved from the opened state to the closed state, the valve body 46 of the second control valve 35 is reliably moved from the closing position to the opening position.

(4) A restriction passage, which functions as a part of the bleed passage during the OFF operation or the variable displacement operation, can be easily formed in the valve body 46 of the second control valve 35.

(5) During the maximum displacement operation, the second control valve 35 adjusts the cross-sectional area of the bleed passage to a value greater than that during the variable displacement operation. Therefore, the pressure in the first back pressure chamber 63 during the maximum displacement operation is low. As a result, the force required for reducing the cross-sectional area of the suction passage of the suction restricting valve 34 is reduced, so that the pressure loss in the suction passage caused by the suction restricting valve 34 is lowered.

The present invention may be modified as follows.

The suction restricting valve 34, the second control valve 35, and the check valve 53 may be accommodated in a common accommodating chamber.

The suction restricting valve 34 and the second control valve 35 may be accommodated in different accommodating chambers. In this case, the first back pressure chamber 63 is formed in the accommodating chamber for the suction restricting valve 34.

The movable spring seat 59 may be omitted, and the end wall 61 may function as the valve seat for the urging spring 58.

The restriction passage 461 of the valve body 46 may be omitted. In this case, in addition to a first bleed passage, which is formed by the passage 54, the first back pressure chamber 63, the third valve hole 481, the fourth valve hole 482, and the passage 65, a second bleed passage is provided that connects the suction chamber 131 and the control pressure chamber 121 with each other, and an orifice is provided in the second bleed passage. The valve body 46 of the second control valve 35 closes the first bleed passage connected to the suction chamber 131 during the OFF operation or the maximum displacement operation. Therefore, the pressure in the first back pressure chamber 63 in the variable displacement operation is high.

The check valve 53 in the first embodiment may be omitted. Even in this case, the same advantages as the advantages (1), (2), and (4) of the first embodiment are achieved.

As the first control valve, a control valve may be used that includes a pressure sensing portion. The pressure sensing portion increases or decreases the valve opening degree in accordance with the pressure difference between two points in the discharge pressure zone. That is, such a control valve may be used as a first control valve that increases the valve opening degree when the flow rate of refrigerant in the discharge pressure zone is increased, and decreases the valve opening degree when the flow rate of refrigerant in the discharge pressure zone is decreased.

The first control valve, the second control valve, and the check valve 53 may be located outside the housing of the variable displacement compressor, and the first and second control valves and the check valve 53 may be connected to the suction chamber or the discharge chamber via piping.

The present invention may be applied to a variable displacement compressor that receives drive force from an external drive power via a clutch. Such a variable displacement compressor can be configured such that, when the clutch is engaged, refrigerant circulates through the external refrigerant circuit even when the inclination angle of the swash plate is minimum, and such that, when the clutch is disengaged, refrigerant is not circulated through the external refrigerant circuit.

What is claimed is:

1. A variable displacement compressor in which a suction pressure zone, a discharge pressure zone and a control pressure chamber are formed, wherein displacement of the variable displacement compressor varies in accordance with pressure in the control pressure chamber by supplying refrigerant in the discharge pressure zone to the control pressure chamber via a supply passage and releasing the refrigerant in the control pressure chamber to the suction pressure zone via a bleed passage, the variable displacement compressor comprising:

a first control valve for adjusting the cross-sectional area of the supply passage;

a suction restricting valve having a valve body and a back pressure chamber, wherein the valve body changes the cross-sectional area of a suction passage that extends from the external refrigerant circuit to the suction chamber, and the back pressure chamber is used for applying a back pressure to the valve body to act against the pressure in the suction passage; and a second control valve that adjusts the cross-sectional area of the bleed passage in accordance with the opening/closing state of the first control valve, wherein the second control valve adjusts the cross-sectional area of the bleed passage such that the cross-sectional area of the bleed passage when the first control valve is in the closed state is larger than that when the first control valve is in the opened state, and the back pressure chamber is located in a section of the bleed passage that is located between the second control valve and the control pressure chamber.

2. The variable displacement compressor according to claim 1, wherein the suction restricting valve and the second control valve are accommodated in a common accommodating chamber.

3. The variable displacement compressor according to claim 2, wherein the accommodating chamber is located in a rear housing member of the compressor.

4. The variable displacement compressor according to claim 1, wherein a check valve is located in a section of the supply passage that is between the first control valve and the control pressure chamber.

5. The variable displacement compressor according to claim 1, wherein the second control valve includes a second valve body, which has a restriction passage.

* * * * *